US008201538B2

(12) United States Patent
Imazato

(10) Patent No.: US 8,201,538 B2
(45) Date of Patent: Jun. 19, 2012

(54) CYLINDER HEAD OIL PASSAGE STRUCTURE

(75) Inventor: Aritoshi Imazato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 502 days.

(21) Appl. No.: 12/297,834

(22) PCT Filed: Apr. 11, 2007

(86) PCT No.: PCT/JP2007/057986
§ 371 (c)(1),
(2), (4) Date: Oct. 20, 2008

(87) PCT Pub. No.: WO2007/135816
PCT Pub. Date: Nov. 29, 2007

(65) Prior Publication Data

US 2009/0078230 A1 Mar. 26, 2009

(30) Foreign Application Priority Data

May 22, 2006 (JP) ..... 2006-141424

(51) Int. Cl.
*F01M 3/04* (2006.01)
*F01M 1/06* (2006.01)

(52) U.S. Cl. ..... 123/196 M; 123/196 R; 123/90.33; 123/90.35

(58) Field of Classification Search ..... 123/196 M, 123/90.35, 196 R, 90.33, 90.48
See application file for complete search history.

(56) References Cited

U.S. PATENT DOCUMENTS 4,329,949 A * 5/1982 Abts et al. ..... 123/90.34
5,031,586 A * 7/1991 Masuda et al. ..... 123/90.27
5,195,472 A * 3/1993 Jacques et al. ..... 123/90.33
5,730,095 A * 3/1998 Dohn et al. ..... 123/193.5

(Continued)

FOREIGN PATENT DOCUMENTS

DE 44 17 480 C1 5/1995

(Continued)

OTHER PUBLICATIONS

International Search Report of PCT/JP2007/057986, date of mailing Jun. 26, 2007.

(Continued)

*Primary Examiner* — Marguerite McMahon
*Assistant Examiner* — Grant Moubry
(74) *Attorney, Agent, or Firm* — Westerman, Hattori, Daniels & Adrian, LLP

(57) ABSTRACT

An oil communication passage (39*b*) is formed so as to run through a wall portion (39) separating an oil collector (41) and an oil drop hole (38) formed in an engine cylinder head (14), and oil that has collected in the oil collector (41) can therefore be guided to the oil drop hole (38) via the oil communication passage (39*b*). An oil supply passage (39*c*) and a retaining hole (39*a*) for retaining a hydraulic tappet (22), which is operated by oil supplied from the oil supply passage (39*c*), are formed in the wall portion (39) of the cylinder head (14), and the oil supply passage (39*c*) and the oil communication passage (39*b*) communicate with each other via the retaining hole (39*a*); therefore, even if part of the oil supplied from the oil supply passage (39*c*) to the hydraulic tappet (22) leaks into the retaining hole (39*a*), the oil can be discharged by utilizing the oil communication passage (39*b*).

1 Claim, 4 Drawing Sheets

U.S. PATENT DOCUMENTS

| | | | | |
|---|---|---|---|---|
| 6,575,127 | B2 * | 6/2003 | Kobayashi | 123/90.15 |
| 6,598,578 | B2 * | 7/2003 | Takahashi et al. | 123/196 R |
| 6,796,281 | B2 * | 9/2004 | Shimoyama et al. | 123/188.2 |
| 7,377,246 | B2 * | 5/2008 | Maassen | 123/90.34 |

FOREIGN PATENT DOCUMENTS

| | | | |
|---|---|---|---|
| EP | 0 821 144 | A1 | 1/1998 |
| JP | 56-126608 | A | 10/1981 |
| JP | 59-29714 | A | 2/1984 |
| JP | 3-73640 | U | 7/1991 |
| JP | 4-112910 | A | 4/1992 |

OTHER PUBLICATIONS

Supplementary European Search Report dated Apr. 14, 2009, issued in corresponding European Patent Application No. 07 74 1422.

* cited by examiner

CYLINDER HEAD OIL PASSAGE STRUCTURE

TECHNICAL FIELD

The present invention relates to a cylinder head oil passage structure that includes an oil drop hole formed in an engine cylinder head, a wall portion that separates the oil drop hole from an oil collector formed in the cylinder head, and an oil communication passage that runs through the wall portion and enables oil to flow from the oil collector to the oil drop hole.

BACKGROUND ART

When a spring-receiving hole for supporting a lower end of a valve spring of an intake valve and an exhaust valve is recessed in an upper face of an engine cylinder head, there is the problem that oil that has lubricated a valve operating mechanism builds up in the spring-receiving hole and cannot be discharged. An arrangement in which an oil guide channel is made to run through a bridging part that projects so as to be a barrier between the spring-receiving hole and an oil drop hole formed in a side edge of a cylinder head, and oil that has collected in the spring-receiving hole is discharged to the oil drop hole via the oil guide channel is known from Patent Publication 1 below.

Patent Publication 1: Japanese Patent Application Laid-open No. 4-112910

DISCLOSURE OF INVENTION

Problems to be Solved by the Invention

In an engine valve operating mechanism, an oil-utilizing member such as a hydraulic tappet is sometimes fitted into and retained by a retaining hole bored in a cylinder head. In such a case, it is necessary to provide an oil discharge hole for discharging oil that has leaked from the hydraulic tappet into the retaining hole, and there is a possibility that the cost of machining of the oil discharge hole will increase and the cylinder head will increase in size in order to ensure that there is space for forming the oil discharge hole.

The present invention has been accomplished in the light of the above-mentioned circumstances, and it is an object thereof to enable oil that has leaked from an oil-utilizing member provided in an engine cylinder head to be discharged without providing a special oil discharge hole.

Means for Solving the Problems

In order to attain the above object, according to a first aspect of the present invention, there is proposed a cylinder head oil passage structure comprising an oil drop hole formed in an engine cylinder head, a wall portion that separates the oil drop hole from an oil collector formed in the cylinder head, and an oil communication passage that runs through the wall portion and enables oil to flow from the oil collector to the oil drop hole, characterized in that the wall portion has formed therein an oil supply passage and a retaining hole retaining an oil-utilizing member that utilizes oil supplied from the oil supply passage, and the retaining hole provides communication between the oil supply passage and the oil communication passage.

According to a second aspect of the present invention, in addition to the first aspect, the cylinder head is inclined so that the oil collector is higher than an opening of the oil drop hole.

According to a third aspect of the present invention, in addition to the first or second aspect, the oil-utilizing member comprises a plurality of hydraulic tappets provided in a cylinder line direction, and the oil supply passage extends linearly in the cylinder line direction within the wall portion and communicates with the retaining hole for each of the hydraulic tappets.

An intake side hydraulic tappet 22 of an embodiment corresponds to the oil-utilizing member of the present invention.

Effects of the Invention

In accordance with the first aspect of the present invention, since the oil communication passage is formed so as to run through the wall portion separating the oil collector from the oil drop hole formed in the cylinder head, oil that has collected in the oil collector can be guided to the oil drop hole via the oil communication passage. Since the oil supply passage and the retaining hole for retaining the oil-utilizing member, which utilizes oil supplied from the oil supply passage, are formed in the wall portion of the cylinder head, and the oil supply passage and the oil communication passage communicate with each other via the retaining hole, even if part of the oil supplied from the oil supply passage to the oil-utilizing member leaks into the retaining hole, the oil can be discharged by utilizing the oil communication passage. This makes it unnecessary to form a special oil discharge hole in the wall portion, and enables the cost of machining the wall portion to be reduced and the wall portion to be made small.

Furthermore, in accordance with the second aspect of the present invention, since the oil collector is made higher than the opening of the oil drop hole by inclining the cylinder head, it is possible to reliably guide oil that has collected in the oil collector to the oil drop hole by virtue of gravity.

Moreover, in accordance with the third aspect of the present invention, since the oil supply passage, which extends linearly within the wall portion of the cylinder head in the cylinder line direction, is made to communicate with the retaining holes for the plurality of hydraulic tappets provided in the cylinder line direction, it is possible to reduce the cost of machining the oil supply passage and prevent the wall portion of the cylinder head from increasing in size while enabling oil to be reliably supplied to the plurality of hydraulic tappets.

EXPLANATION OF REFERENCE NUMERALS AND SYMBOLS

14 Cylinder head
22 Hydraulic tappet (oil-utilizing member)
38 Oil drop hole
38*a* Opening
39 Wall portion
39*a* Retaining hole
39*b* Oil communication passage
39*c* Oil supply passage

41 Oil collector
L Cylinder line

BEST MODE FOR CARRYING OUT THE INVENTION

A mode for carrying out the present invention is explained below by reference to the attached drawings.

Embodiment 1

FIG. 1 to FIG. 4 show a mode for carrying out the present invention.

Figure 1:
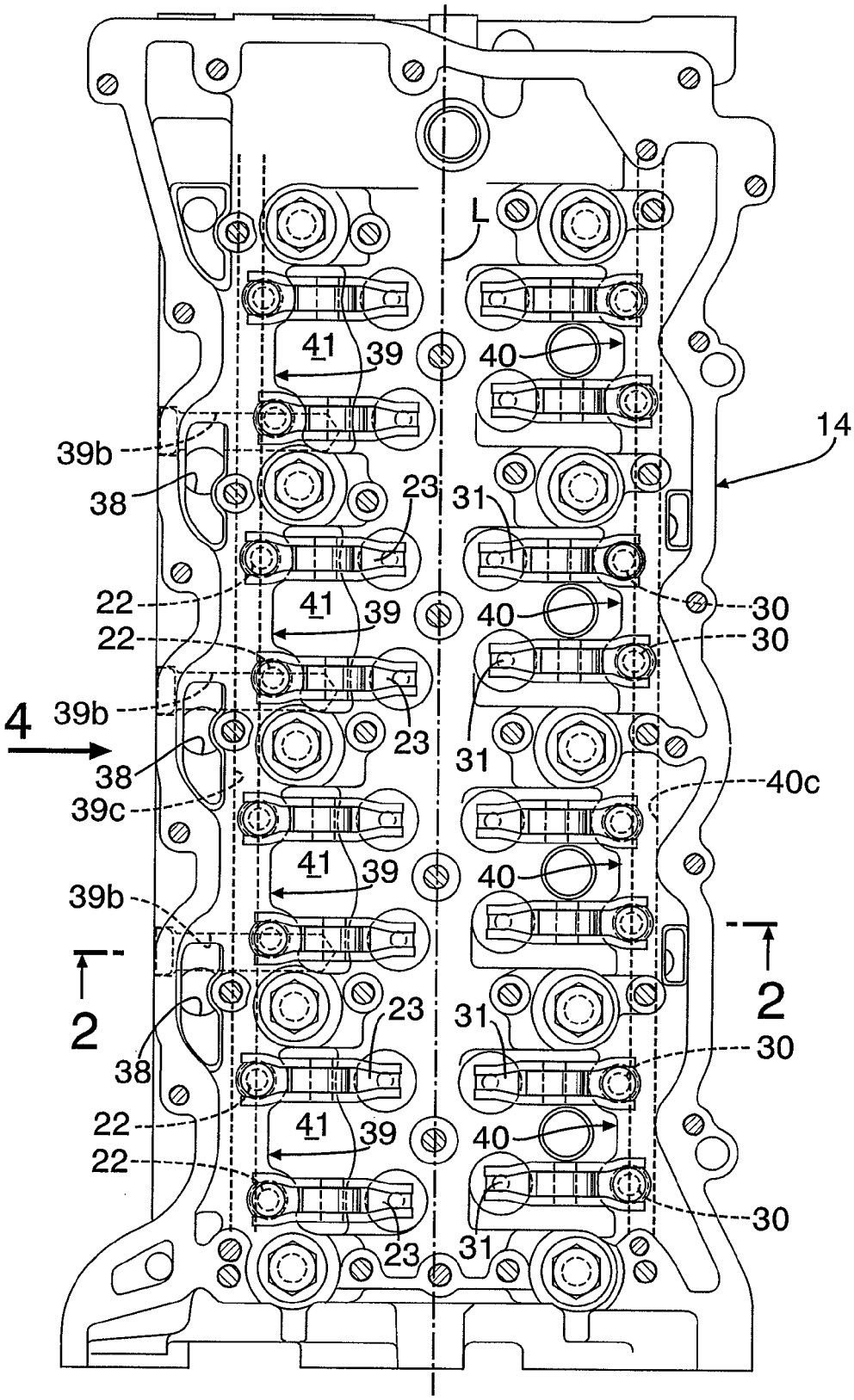
FIG. 1 is a plan view of a cylinder head of a diesel engine (view from arrowed line 1-1 in FIG. 2) (first embodiment).
Figure 2:
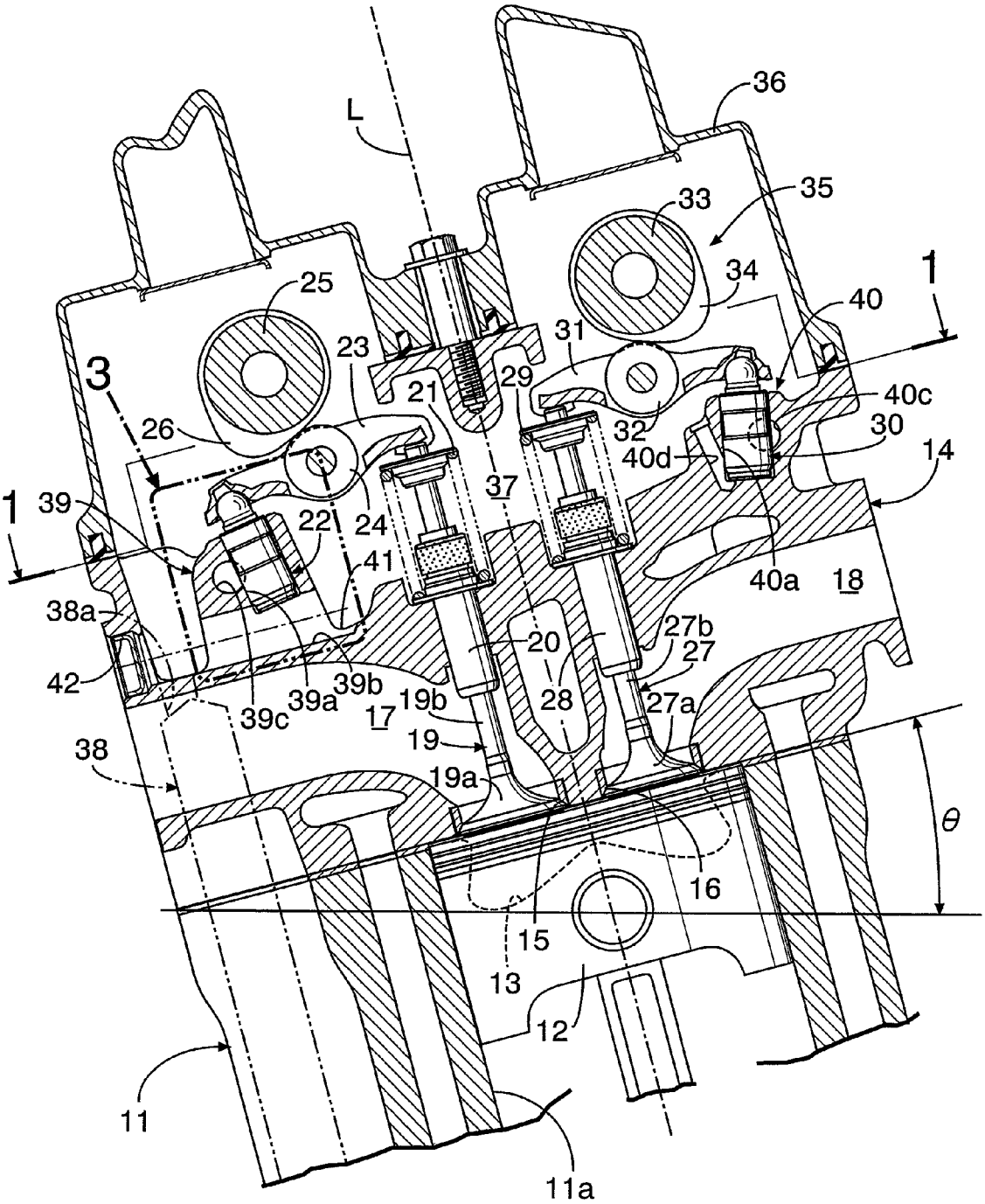
FIG. 2 is a sectional view along line 2-2 in FIG. 1 (first embodiment).

As shown in FIG. 1 and FIG. 2, an in-line four cylinder diesel engine mounted on an automobile includes four pistons 12 slidably fitted into four cylinders 11*a* formed in a cylinder block 11, and a reentrant-type combustion chamber 13 is recessed in a top face of each of the pistons 12. Intake valve holes 15 and 15 and exhaust valve holes 16 and 16 facing the top face of each of the pistons 12 open on a lower face of a cylinder head 14 joined to an upper face of the cylinder block 11, an intake port 17 communicates with the intake valve hole 15, and an exhaust port 18 communicates with the exhaust valve hole 16.

An intake valve 19 includes a valve body 19*a* that opens and closes the intake valve hole 15 and a valve stem 19*b* connected to the valve body 19*a*, and the valve stem 19*b*, which is disposed in parallel to a cylinder axis L, is slidably supported on a valve guide 20 and is urged by an intake valve spring 21 in a valve-closing direction. An intake rocker arm 23 having one end supported on a hydraulic tappet 22 has the other end abutting against a stem end of the intake valve 19, and a roller 24 provided in a middle portion abuts against an intake cam 26 provided on an intake camshaft 25.

An exhaust valve 27 includes a valve body 27*a* that opens and closes the exhaust valve hole 16 and a valve stem 27*b* connected to the valve body 27*a*, the valve stem 27*b*, which is disposed in parallel to the cylinder axis L, is slidably supported on a valve guide 28 and urged by an exhaust valve spring 29 in a valve-closing direction. An exhaust rocker arm 31 having one end supported on a hydraulic tappet 30 has the other end abutting against a stem end of the exhaust valve 27, and a roller 32 provided in a middle portion abuts against an exhaust cam 34 provided on an exhaust camshaft 33.

A valve operating mechanism 35 having such an arrangement is covered by a head cover 36 joined to an upper face of the cylinder head 14.

This diesel engine is mounted transversely in an engine compartment, while being inclined by an angle θ so that the exhaust side, which faces the front of a vehicle body, is higher and the intake side, which faces the rear of the vehicle body, is lower (see FIG. 2). Oil is supplied from an oil jet (not illustrated) to a valve operation chamber 37 defined by the cylinder head 14 and the head cover 36 in order to lubricate the valve operating mechanism 35, which is housed therein. In order to return oil that has lubricated the valve operating mechanism 35 in the valve operation chamber 37 to an oil pan (not illustrated) via the interior of a side wall of the cylinder block 11, openings 38*a* of three oil drop holes 38 open in the lowest portion of the valve operation chamber 37, that is, an end portion on the intake side.

A total of eight of the hydraulic tappets 22 on the intake side are provided for the four cylinders 11*a*. A wall portion 39 is projectingly provided on the upper face of the cylinder head 14, the wall portion 39 rising in a bank shape along one side of a cylinder line L, and the eight hydraulic tappets 22 are fitted into and retained by eight retaining holes 39*a* bored in the wall portion 39 so as to face downward. Similarly, a total of eight of the hydraulic tappets 30 on the exhaust side are provided for the four cylinders 11*a*. A wall portion 40 is projectingly provided on the upper face of the cylinder head 14, the wall portion 40 rising in a bank shape along the other side of the cylinder line L, and the eight hydraulic tappets 30 are fitted into and retained by eight retaining holes 40*a* bored in the wall portion 40 so as to face downward.

A downwardly recessed oil collector 41 is formed on the cylinder line L side of the intake side wall portion 39 formed on the upper face of the cylinder head 14. Therefore, the oil collector 41 and the three oil drop holes 38 are disposed on opposite sides with respect to the intake side wall portion 39, and oil that has collected in the oil collector 41 is blocked by the wall portion 39 and cannot flow into the oil drop holes 38. Three oil communication passages 39*b* running transversely through the wall portion 39 guide the oil of the oil collector 41 to the openings 38*a* of the oil drop holes 38. The oil communication passages 39*b* are machined from a side wall side of the cylinder head 14, and open ends thereof are closed by caps 42 for preventing the oil from flowing out.

In order to supply oil to the eight hydraulic tappets 22 on the intake side, one straight oil supply passage 39*c* is formed within the wall portion 39 in parallel to the cylinder line L, this oil supply passage 39*c* communicating with all of the eight retaining holes 39*a*. In this way, since the one straight oil supply passage 39*c* provided within the wall portion 39 communicates with the retaining holes 39*a* for the eight hydraulic tappets 22, the structure for supplying oil to the eight hydraulic tappets 22 can be simplified. Among the eight hydraulic tappets 22 on the intake side, the retaining holes 39*a* for three of the hydraulic tappets 22 respectively communicate with the oil communication passages 39*b* (see FIG. 2 and FIG. 3).

In order to supply oil to the eight hydraulic tappets 30 on the exhaust side, one straight oil supply passage 40*c* is formed within the wall portion 40 in parallel to the cylinder line L, this oil supply passage 40*c* communicating with all of the eight retaining holes 40*a*. In this way, since the one straight oil supply passage 40*c* provided within the wall portion 40 communicates with the retaining holes 40*a* for the eight hydraulic tappets 30, the structure for supplying oil to the eight hydraulic tappets 30 can be simplified. Base parts of the eight exhaust side retaining holes 40*a* and the upper face of the cylinder head 14 communicate with each other via oil discharge holes 40*d*.

The retaining holes 39*a* for the five hydraulic tappets 22 other than the three hydraulic tappets 22 on the intake side communicate with the upper face of the cylinder head 14 via an oil discharge hole (not illustrated) having the same structure as that of the oil discharge holes 40*d* on the exhaust side.

Figure 3:
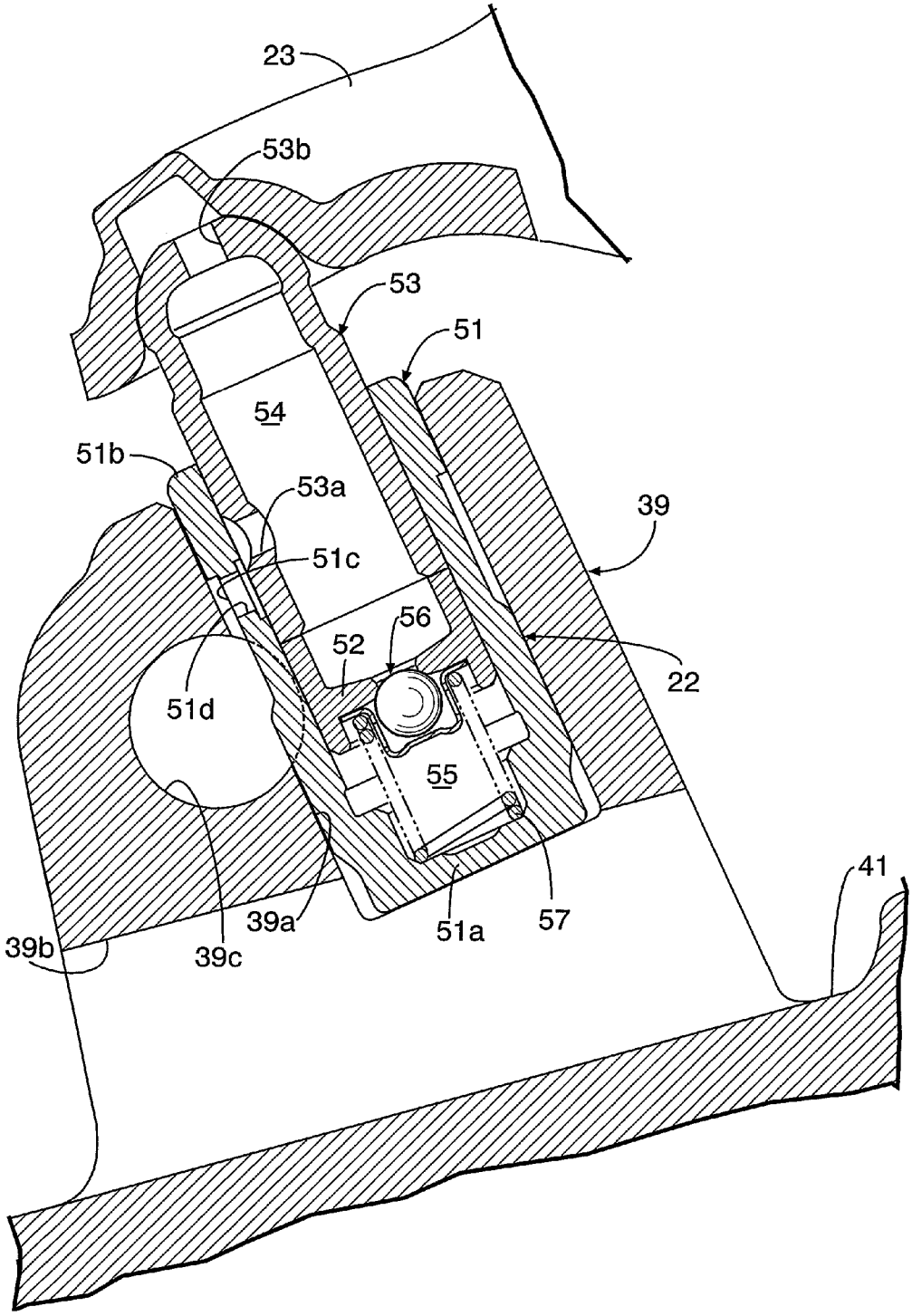
FIG. 3 is an enlarged sectional view of part 3 in FIG. 2 (first embodiment).
Figure 4:
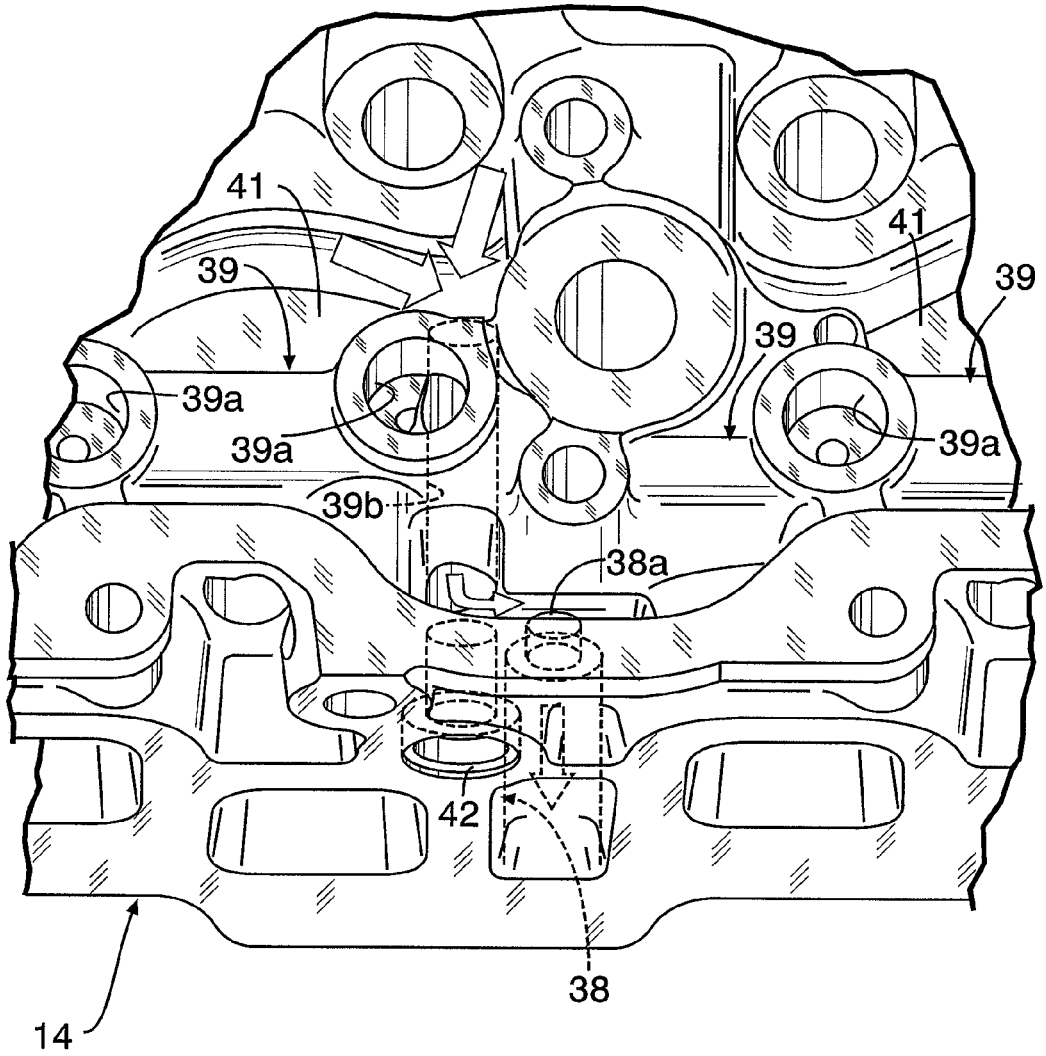
FIG. 4 is a view from arrow 4 in a state in which a head cover in FIG. 2 is detached (first embodiment).

Since the hydraulic tappet 22 on the intake side and the hydraulic tappet 30 on the exhaust side have the same structure, the structure of the hydraulic tappet 22 on the intake side is explained as being representative thereof by reference to FIG. 3.

The hydraulic tappet 22 includes a bottomed cylindrical body 51, a plunger 52 slidably fitted to a bottom wall 51*a* side of the body 51, a pushrod 53 slidably fitted to an opening 51*b* side of the body 51 and having a lower end abutting against the plunger 52 and an upper end abutting against the intake rocker arm 23, a reservoir 54 defined by the plunger 52 and the pushrod 53, a high pressure chamber 55 defined by the bottom wall 51*a* of the body 51 and the plunger 52, a check valve 56 provided at the lower end of the plunger 52, and a spring 57 for urging the plunger 52 and the pushrod 53 toward the intake rocker arm 23 side.

In a state in which the body 51 of the hydraulic tappet 22 is fitted into and retained by the retaining hole 39*a* of the wall portion 39, the oil supply passage 39*c* of the wall portion 39 communicates with the reservoir 54 of the hydraulic tappet 22 via an annular channel 51*c* formed in the outer periphery of the body 51, a through hole 51*d* running through the body 51, and a through hole 53*a* running through the pushrod 53. Therefore, oil supplied from an oil pump (not illustrated) is supplied from the oil supply passage 39*c* to the reservoir 54 of the hydraulic tappet 22. A through hole 53*b* is formed in a top part of the pushrod 53, the through hole 53*b* supplying oil for lubricating a portion that is in contact with the intake rocker arm 23.

Operation of the mode for carrying out the present invention having the above-mentioned arrangement is now explained.

When the intake camshaft 25 rotates, the intake rocker arm 23 having the roller 24 pushed by the intake cam 26 swings with the hydraulic tappet 22 as a fulcrum, and pushes the stem end of the intake valve 19 against a resilient force of the intake valve spring 21, thus opening the valve. Furthermore, when the exhaust camshaft 33 rotates, the exhaust rocker arm 31 having the roller 32 pushed by the exhaust cam 34 swings with the hydraulic tappet 30 as a fulcrum, and pushes the stem end of the exhaust valve 27 against a resilient force of the exhaust valve spring 29, thus opening the valve.

The hydraulic tappet 22 on the intake side absorbs valve clearance accompanying thermal expansion or wear of the intake valve 19, and before lifting of the intake cam 26 is started, the valve clearance is maintained at 0 by a resilient force of the spring 57 pushing up the plunger 52 and the pushrod 53. At this time, the high pressure chamber 55 is filled with oil.

When lifting of the intake cam 26 is started, a downward load is applied to the plunger 52 and the pushrod 53 by the intake rocker arm 23, but since the check valve 56 is closed, there is essentially no movement of the plunger 52 and the pushrod 53. However, since a small amount of oil in the high pressure chamber 55 leaks through a very small clearance between an inner wall of the body 51 and outer walls of the plunger 52 and the pushrod 53, the plunger 52 and the pushrod 53 descend slightly by an amount corresponding to the amount of oil that has leaked.

If the plunger 52 and the pushrod 53 thus descend slightly, when the cam lift of the intake cam 26 reaches a final section, since the load from the intake rocker arm 23 is not applied to the pushrod 53, the plunger 52 and the pushrod 53 are raised by the resilient force of the spring 57 so as to follow the rocker arm 23, and the valve clearance is maintained at 0. At this time, the check valve 56 opens, and the high pressure chamber 55 is filled with oil from the reservoir 54. Furthermore, oil in the reservoir 54 flows out via the through hole 53*b* at the upper end of the pushrod 53, thus lubricating sliding portions of the pushrod 53 and the rocker arm 23.

The function of the hydraulic tappet 30 on the exhaust side is the same as the function of the hydraulic tappet 22 on the intake side, which is described above.

It is necessary for oil that has been supplied to the valve operation chamber 37 to lubricate the valve operating mechanism 35, then flow along an upper wall of the cylinder head 14, which is inclined so that the intake side is lower, and return to the oil pan via the three oil drop holes 38. However, in practice, since the bank-shaped wall portion 39 projects from the upper wall of the cylinder head 14, and the oil collector 41 is formed immediately in front thereof (on the exhaust side), oil that has collected in the oil collector 41 is blocked by the wall portion 39 and cannot flow smoothly into the oil drop holes 38.

However, in accordance with the present embodiment, since the three oil communication passages 39*b* are formed in the wall portion 39, oil in the oil collector 41 can flow smoothly into the oil drop holes 38 through the three oil communication passages 39*b*. In this process, since the cylinder head 14 is inclined so that the intake side is lower than the exhaust side, oil in the oil collector 41 can flow yet more smoothly into the oil drop holes 38 by virtue of gravity.

Since the hydraulic tappet 22 is fitted into the retaining hole 39*a* of the wall portion 39 with good precision via the very small gap, unless air trapped in a bottom part of the retaining hole 39*a* during the installation thereof is released, the hydraulic tappet 22 cannot be installed. However, since, among the eight hydraulic tappets 22 on the intake side, base parts of retaining holes 39*a* for three hydraulic tappets 22 communicate with the three oil communication passages 39*b*, the air trapped can be released to the oil communication passages 39*b*, thereby enabling the hydraulic tappets 22 to be installed without any problem.

Moreover, part of the oil supplied from the oil supply passage 39*c* of the wall portion 39 leaks between the outer face of the bodies 51 of the hydraulic tappets 22 and the inner face of the retaining holes 39*a*, and since the base parts of the retaining holes 39*a* for the three hydraulic tappets 22 communicate with the three oil communication passages 39*b*, oil that has thus leaked can be discharged from the oil communication passages 39*b* to the oil drop holes 38, thus preventing the hydraulic tappets 22 from lifting from the retaining holes 39*a* due to the pressure of the oil.

On the other hand, since the retaining holes 40*a* for the eight hydraulic tappets 30 on the exhaust side, and the retaining holes 39*a* for the remaining five hydraulic tappets 22 on the intake side do not communicate with the oil communication passages 39*b*, it is necessary to specially machine the oil discharge holes 40*d* (see FIG. 2) in order to discharge the air or leaked oil. Oil discharge holes communicating with the retaining holes 39*a* for the remaining five hydraulic tappets 22 on the intake side are not illustrated.

As described above, since the oil communication passages 39*b*, which run through the wall portion 39 protruding so as to be a barrier between the oil drop holes 38 and the oil collector 41, are formed, it is possible to guide oil that has collected in the oil collector 41 into the oil drop holes 38 via the oil communication passages 39*b* and discharge it to the oil pan. Moreover, since the retaining holes 39*a* formed in the wall portion 39 and retaining the hydraulic tappets 22 communicate with the oil communication passages 39*b*, even if oil supplied from the oil supply passage formed in the wall portion 39 to the hydraulic tappets 22 leaks into the retaining holes 39*a*, it becomes possible to guide the oil to the oil drop holes 38 by utilizing the oil communication passages 39*b*. This makes it unnecessary to form a special oil discharge hole in the wall portion 39, thereby enabling the cost of machining the wall portion 39 to be reduced and the wall portion 39 to be made small.

A mode for carrying out the present invention is explained above, but the present invention may be modified in a variety of ways as long as the modifications do not depart from the spirit and scope thereof.

For example, the oil-utilizing member of the present invention is not limited to the hydraulic tappet 22 of the embodiment, and it may be one such as an actuator of a variable cam phase mechanism for varying the phase of a valve operating cam.

The invention claimed is:

1. A cylinder head oil passage structure, comprising:

oil drop holes formed in a lowest portion of a valve operation chamber in a cylinder head of an engine that is mounted in an inclined state, a wall portion that rises in a bank shape along one side of a cylinder line on an upper face of the cylinder head, each oil drop hole and an oil collector that is formed in the cylinder head at a position higher than openings of said oil drop holes being arranged with said wall portion being interposed therebetween so as to traverse the wall portion, and oil communication passages that run through the wall portion and enable oil to flow from the oil collector to the oil drop holes, wherein the wall portion has formed therein an oil supply passage extending linearly in a direction of the cylinder line and retaining holes retaining a plurality of hydraulic tappets, respectively, that are provided in the direction of the cylinder line and utilize oil supplied from the oil supply passage, and the retaining holes provide communication between the oil supply passage and the respective oil communication passages.

* * * * *